US005234659A

United States Patent [19]

Moen

[11] Patent Number: 5,234,659

[45] Date of Patent: Aug. 10, 1993

[54] PLANT FOR CONDUCTIVE ELECTRICAL HEATING OF STEEL BLANKS

[76] Inventor: Asbjorn Moen, Tasen Terrasse 19, N-0873 Oslo 8, Norway

[21] Appl. No.: 776,309

[22] PCT Filed: May 16, 1990

[86] PCT. No.: PCT/NO90/00084

§ 371 Date: Nov. 15, 1991

§ 102(e) Date: Nov. 15, 1991

[87] PCT Pub. No.: WO90/14741

PCT Pub. Date: Nov. 29, 1990

[30] Foreign Application Priority Data

May 16, 1989 [NO] Norway ..... 891961

[51] Int. Cl.[5] ..... C21D 1/40

[52] U.S. Cl. ..... 266/104; 266/249; 219/156

[58] Field of Search ..... 266/103, 104, 249, 105; 219/156

[56] References Cited

U.S. PATENT DOCUMENTS

| | | | |
|---|---|---|---|
| 2,248,280 | 7/1941 | Nobiron et al. | 219/156 |
| 3,082,319 | 3/1963 | Watson | 219/156 |
| 3,743,778 | 7/1973 | Day | 219/156 |

FOREIGN PATENT DOCUMENTS

| | | |
|---|---|---|
| 0133877 | 6/1984 | European Pat. Off. . |
| 1005212 | 3/1957 | Fed. Rep. of Germany . |
| 1005657 | 4/1957 | Fed. Rep. of Germany . |
| 1146605 | 5/1957 | France . |
| 0609240 | 9/1948 | United Kingdom . |
| 1523130 | 12/1975 | United Kingdom . |

OTHER PUBLICATIONS

Patent Abstracts of Japan, vol. 3, No. 57, M 59, abstract of JP 54-39239, publ 1979-03-26 Mitsubishi Denki K.K.

*Primary Examiner*—Scott Kastler

*Attorney, Agent, or Firm*—Browdy and Neimark

[57] ABSTRACT

A plant for conductive electrical heating of elongated electrically conductive objects, e.g. steel blanks for further treatment in a roll mill. Said plant comprises a combination of the following features:

at least two blanks (1) are provided in parallel and spaced from each other, and are connected with at least one current supply (2) by the aid of transmission contacts (3, 4), which are provided so as to be urged towards the ends (1*a*, 1*b*) of blanks (1). Blanks (1) with associated transmission contacts (3, 4) are provided in a heat insulated chamber (5), in which blank (1) and chamber (5) together constitute an electrical furnace, in which blanks (1) constitute the heating elements of the furnace. A conveyor or manipulator (7) is provided for insertion, and removal, respectively of blanks (1) in transmission contacts (3, 4) in chamber (5) through an opening (9) in the surrounding chamber wall in any order chosen.

6 Claims, 7 Drawing Sheets

PLANT FOR CONDUCTIVE ELECTRICAL HEATING OF STEEL BLANKS

BACKGROUND OF THE INVENTION

The present invention relates to a plant for conductive electrical heating of elongated electrically conductive bodies, e.g. steel blanks for further treatment, e.g. in a roll mill.

The most important principle for heating blanks to be rolled is at present implemented in furnaces which are based on oil or gas. The blanks are fed through the furnace by the aid of moving beams or by pressure shift of the blank flow through the furnace.

The most important disadvantages of this kind of heating are:

Low efficiency, approximately 50%.

Considerable loss of material by mill scale formation (approximately 2.5–4%).

Long heating period in start-up of rolling.

Considerable pollution of the environment, both air and water.

Considerable maintenance costs.

Low flexibility.

Considerable effort was made to find improved methods of heating blanks for rolling, inter alia, by induction heating and resistance heating by current passage therethrough.

None of said concepts was much used due to considerable drawbacks in these cases as well. Induction heating shows:

Low efficiency, approximately 50%, and is complicated as well as needing bulky equipment.

Previously known concepts with direct current passage have the following disadvantages:

Due to heavy losses because of radiation at higher temperatures, and in order to reduce mill scale formation, and to increase the capacity of the plant, i.e. achievement of sufficient temperature in a short time, it was necessary to use a very high intensity of current (more than 100,000 amps). This causes great practical problems, e.g. problems and costs in connection with contact equipment, high magnetic fields, reactive voltage drop, etc. Grade problems may arise due to cracks forming in the blanks because of too rapid heating and, thus, a non-homogeneous temperature distribution in the blank. The plants are expensive, and show comparatively low efficiency.

Advantages of such plants are: Short heating time, minimum mill scale formation, and the plant does not constitute a heavy load on the environment.

From U.S. Pat. No. 3,082,319 of Watson it is known to connect blanks serially in a circuit for heating to remove blanks for further treatment.

In order to permit removal of a blank without breaking the current passage of the circuit, two parallel blanks are provided between transmission contacts, said pairs of blanks being provided mutually in parallel and spaced from each other in a row, so that two and two blanks are serially connected with other correspondingsly connected blanks. One blank may, thus be removed from a pair of blanks without breaking the circuit, whereupon a new blank may be introduced. During such removal and insertion of blanks the resistance of the circuit will, obviously, increase during the time when a blank is not connected with the transmission contacts, and there will thus be less current in the circuit. The disadvantages of this known heating plant are that the blanks are not connected at their ends with transmission contacts, so that heating becomes uneven. Also, the passage of current in all pairs of blanks is equal, so that no individual adjustment of the heating of the blanks is possible. Furthermore, there will be high loss of heat at such a plant, since transmission contacts with blanks are not shielded against loss of heat.

SUMMARY OF THE INVENTION

It is an object of the present invention to provide a plant for conductive electrical heating of elongated electrically conductive bodies, e.g. blanks of steel for further treatment in a roll mill or the like, in which the mentioned disadvantages are eliminated.

An object of the present invention, furthermore, is to arrive at a concept which utilizes and combines the advantages known plants may have with those achieved by the new principle.

The most important starting point is that two or more blanks are connected serially, in parallel, or in a combination of serial and parallel connection, and that the blanks with transmission contacts are placed in parallel and space from each other in a heat insulated chamber which is provided with openings and manipulator means for insertion, and removal, respectively, of blanks through an opening in the surrounding chamber wall.

One result among others is short feed lines to contact means and, thus, among others low reactance in the circuit. The blanks are, furthermore, placed in parallel spared at a small distance from each other. This arrangement of transmission contacts and blanks provides a good opportunity of insulating the blanks against the environment during heating operations, and the plant will, thus, show very high efficiency. As compared to known plants, the intensity of current may be reduced to approximately 30,000–40,000 amps. The results are:

1. Reduced requirements of contact means, in practice very simple principles may be utilized (water cooled steel cups).
2. A much more uniform distribution of temperature in the blank is achieved.
3. Consequently cracking of the blank is avoided.
4. The mill scale loss is reduced to a minimum due to the following:
   a. The blanks dwell in temperatures from 700° to 1100° C. for a short time (approximately 10 to 15 minutes).
   b. The blanks are in a closed space which will gradually have a low-oxygen atmosphere.
   c. If desired, an inert gas may be used in the furnace in order to achieve further reduction of mill scale formation.

Because of a lower intensity of current a larger number of blanks must be heated simultaneously. This means that the plant must be provided with a number of transformers. An essentially symmetric load on all three phases of current is secured. Connection and disconnection of the circuit occurs on the primary side of each feed transformer.

Due to the procedure of insertion and removal of blanks there are several possible arrangements of the furnace.

The plant shows great flexibility in that blanks may be inserted and removed without consideration of any special order. Commonly, the blank which is the first to obtain rolling temperature will be removed for rolling independent of the point of time when it was inserted or placed in the furnace. This is an important feature for the utilization of the possibilities and capacity of the plant.

In a roll mill with a capacity of 200,000 tons it will probably be possible to save approximately 10 to 15 millions of NOK annually, just because of elimination of mill scale loss as well as reduced energy costs. Additionally, there are all the advantages in connection with maintenance, environment, etc.

Due to the fact that the blanks are in a closed chamber, e.g. a closed furnace, it will be possible, without any loss of energy to connect or disconnect current to the blank to maintain the correct temperature for the moment when it is removed for rolling. Also, the intensity of current is adjustable by adjustment of the applied voltage. It is also intended that cold blanks are inserted at the same time as hot blanks are removed for rolling when stationary operation has been achieved.

Conditions are, thus, favourable for a series of possible technical concepts as regards localization of feed transformers, design of furnace space with conveyance in and out of blanks, insulation of the furnace etc. As opposed to a through-type furnace which is most common today, and from which blanks must be removed in the same order as they are inserted, the blanks according to the present invention may be removed from any selected place. In practice the blank which reaches rolling temperature first is the blank to be removed first. This provides for very good flexibility.

By insertion of blanks of an elevated temperature from a continuous casting plant, considerable energy may be saved. It is, obviously, possible to insert cold blanks and blanks of an elevated temperature at the same time without this causing problems as regards smooth removal of blanks having a correct temperature for being rolled.

By inserting blanks of an elevated temperature the capacity of the plant will increase, or operation of fewer heating circuits for blanks will be required to achieve the same capacity. This will require the plant to be provided with additional heating circuits which may be connected or disconnected as needed.

The temperature of each blank to be heated is checked by temperature measurements shown on a display or the like. It will also be possible to check the temperature on the basis of electrical resistance characteristics of the blanks. The blank stations will be numbered and defined in a control system comprising common automatic or microprocessor based equipment. Such equipment determines the localization of the blank in the process. Blocking means in the automatic equipment ensures that the blanks are inserted and removed in a dead state. These special controls will not be discussed in detail in the description of the drawing.

BRIEF DESCRIPTION OF THE DRAWINGS

The invention will be disclosed in more detail with reference to the drawing, in which

FIG. 2*b* shows a design of a water cooled transmission contact.

DETAILED DESCRIPTION OF PREFERRED EMBODIMENTS

Figure 1:
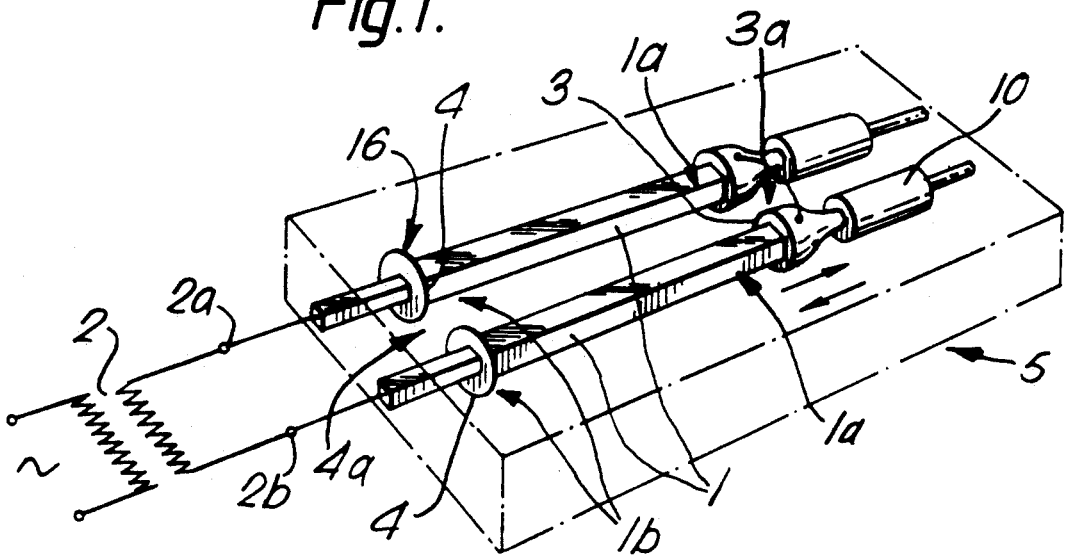
FIG. 1 is a diagrammatical view of the invention in its most simple design with two blanks being serially connected in a chamber, and with connection and disconnection of current being made on the primary side of the transformer.

In FIG. 1 two blanks 1 are shown to be arranged in parallel at a mutual distance and serially connected with a current supply 2 by the aid of transmission contacts 3, 4. Transmission contacts 3, 4 are provided to be urged towards the ends 1*a*, 1*b* of blanks 1. A first set 3*a* of transmission contacts 3 at one end 1*a* of the blanks is connected to short them. The other set 4*a* of transmission contacts 4 is connected with terminals 2*a*, 2*b* of the current supply 2. Blanks 1 and transmission contacts 3, 4 are provided in a heat insulated chamber 5, so that blanks 1 and chamber 5 together form an electric furnace, with the blanks constituting the heating elements of the furnace. Blanks 1 and transmission contacts 3, 4 which are connected with terminals 2*a*, 2*b* of the current supply, form a circuit.

Figure 1A:
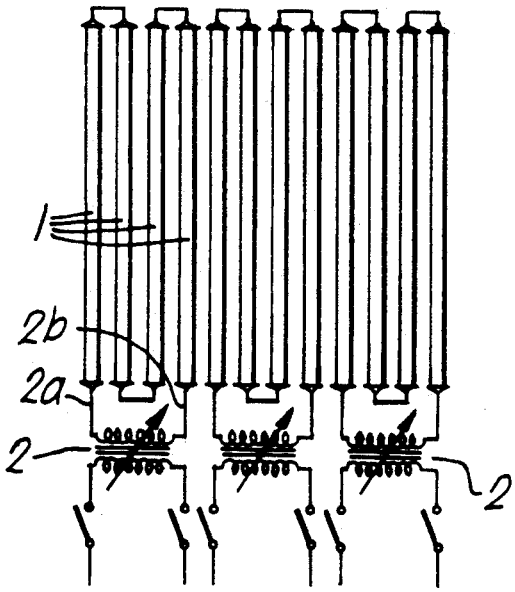
FIG. 1*a* is a diagrammatical view of three groups of serially connected blanks, with each group connected to a separate one-phase transformer/source of current.

FIG. 1*a* shows three circuits, each comprising four blanks 1 which are connected serially and are connected with a current supply 2 each in the shape of a one-phase transformer.

Figure 1B:
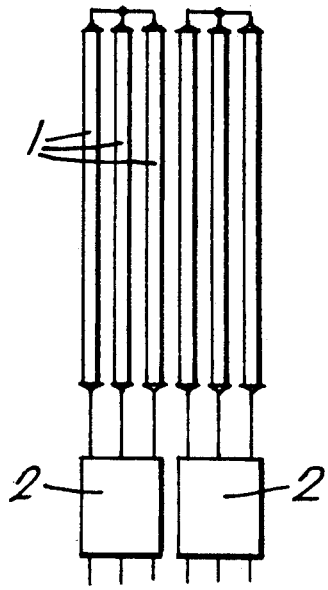
FIG. 1*b* shows two groups of blanks, each of which is connected with a three-phase transformer.

FIG. 1*b* shows two circuits, each of which is connected with a three-phase transformer constituting current supply 2.

Blanks 1 of each group may, obviously, also be connected in parallel or in a combination of serial and parallel in order to achieve different effects as regards heating time and change of the electrical resistance in the group of blanks and consequently, adjustment of the current passage in the circuit.

Figure 2A:
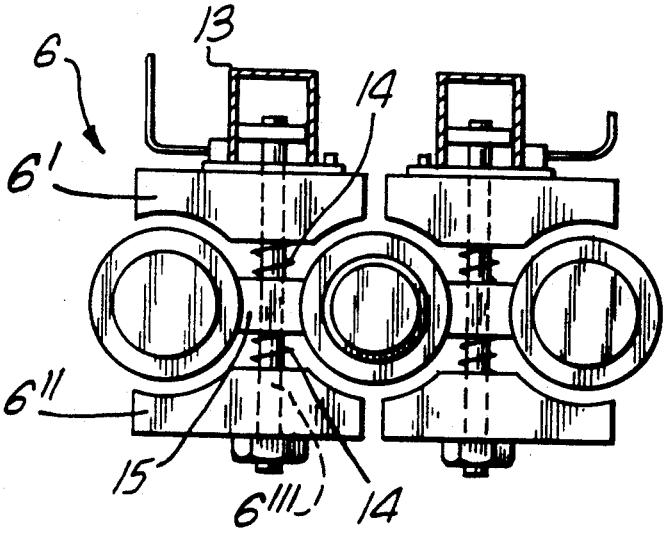
FIG. 2*a* and 2*b* show the design of a secondary switch.
Figure 2C:
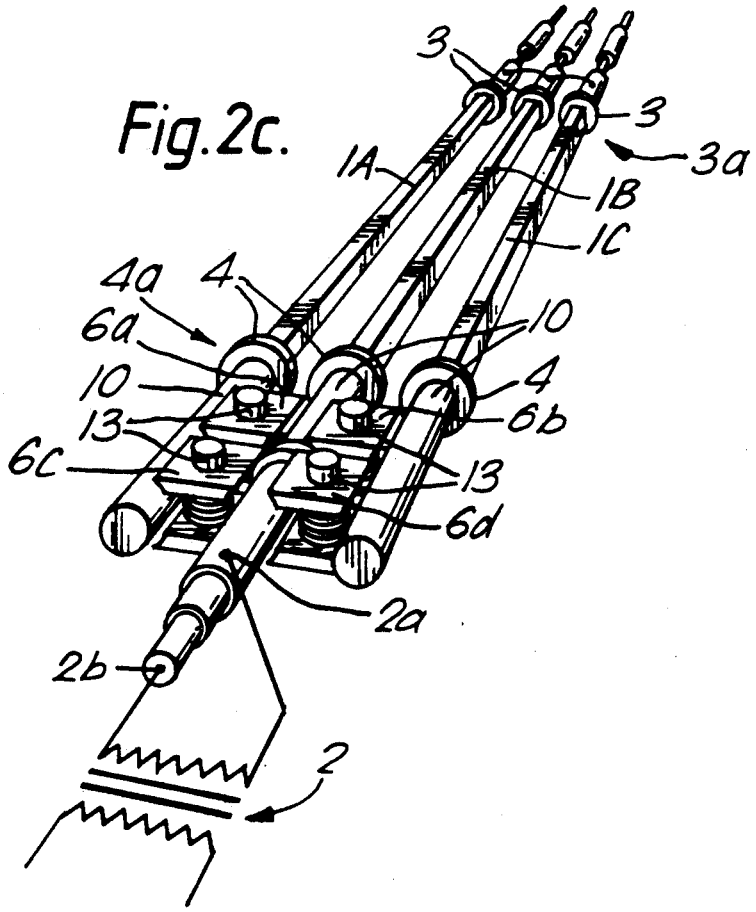
FIG. 2 shows transmission contacts with connected blanks, and secondary switches to achieve alternative connections of the blanks in the circuit, with operation of secondary switches in a disconnected state.
Figure 2:
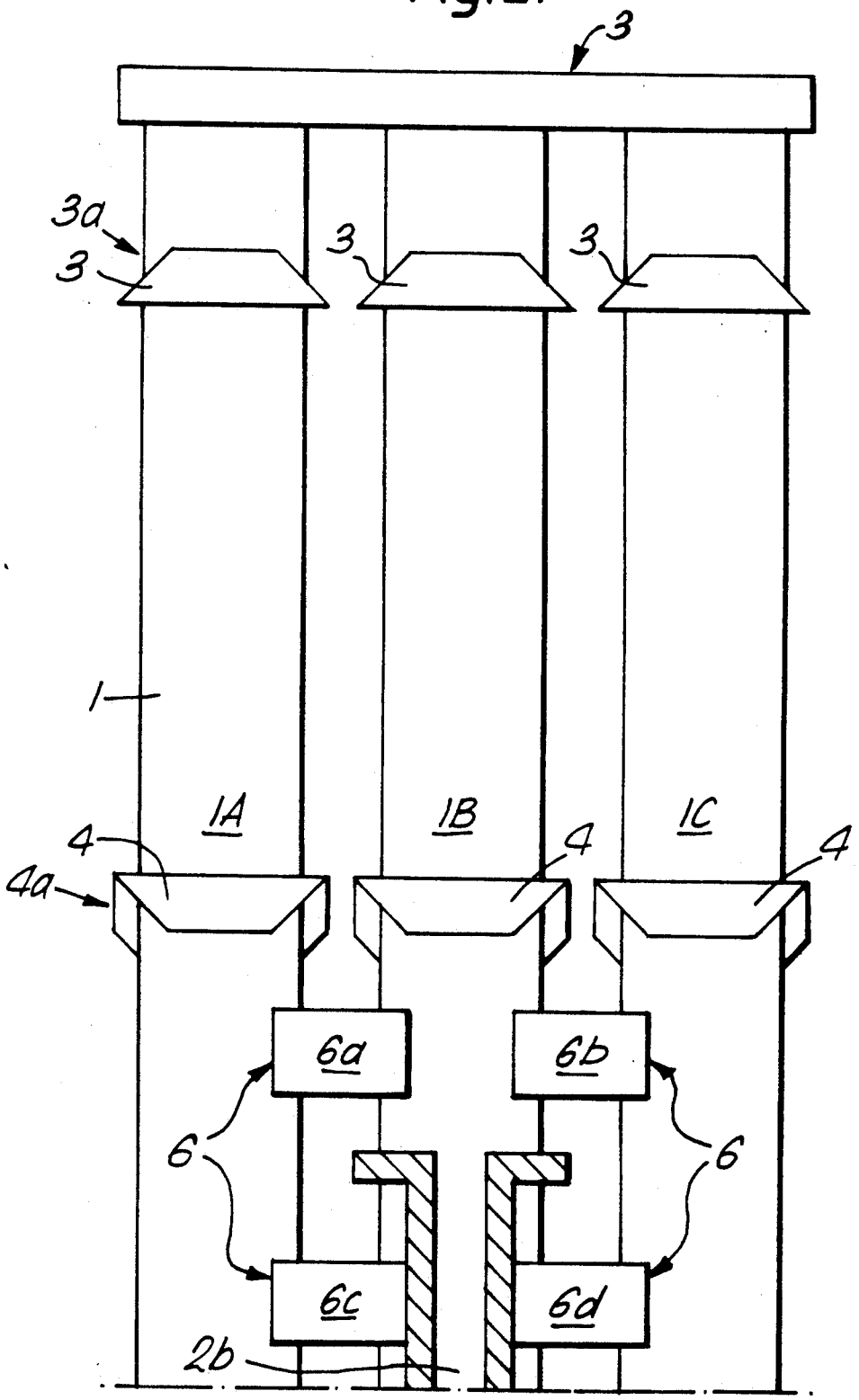

In FIG. 2 an arrangement is shown, in which each set 3*a*, 4*a* of transmission contacts comprises at least three transmission contacts 3, 4. Also, secondary switches 6 are provided between terminals 2*a*, 2*b* of the current supply and the second set of contacts 4*a*. The same is also shown in perspective in FIG. 2*c*, from which it is possible to get a clear picture of how secondary switches 6 are located and designed, i.e. four secondary switches with 6*a*, 6*b*, 6*c*, and 6*d*.

In this manner it is possible to connect alternative circuits through blanks 1 with two blanks in parallel and one blank serially connected with the latter, in any combination of the blanks 1.

Secondary switches 6 are placed between current leads to transmission contact set 4*a*. The current lead to blank 1B has coaxial power leads/terminals 2*a*, 2*b*, which are provided in such a manner that central power lead/terminal 2*b* extends all the way to transmission contact 4, whereas peripheral power lead/terminal 2*a* ends spaced from transmission contact 4. Two free collector portions/terminals 2*a*, 2*b* are, thus, achieved. The secondary switches 6, of a design, e.g. as shown in FIG. 2*a* and in perspective in FIG. 2*c*, are placed between adjacent current supply members to blank 1, designated 1*a*, 1*b*, 1*c*, so that two secondary switches 6*a*, 6*b*, connect external power collector means/terminal 2*b* on the current supply member of blank 1*b* with adjacent means to blanks 1*a* and 1*c*, whereas two other secondary switches 6*c*, 6*d* are provided between second collector portion/terminal 2*a* on the means to blank 1B and adjacent means to blanks 1A and 1C.

By connecting or disconnecting secondary switches, various alternative connections of blanks 1A, 1B, 1C in the circuit are achieved. It is assumed that connection of the secondary switches is made when they are in a dead state.

With disconnected secondary switches 6*a*, 6*b*, and with blank 1B, secondary switches 6*c* and 6*d* being connected, blanks 1A and 1C will, thus, be connected in parallel and serially with 1B.

With disconnected secondary switches 6*a* and 6*d*, and the other two, 6*b*, 6*c* being connected, blanks 1B and 1C will be connected in parallel and serially with blank 1A. With disconnected secondary switches 6*b* and 6*c*, and the other two, 6*a*, 6*d* being connected, blanks 1A and 1B will be connected in parallel and serially with blank 1C.

Figure 2B:
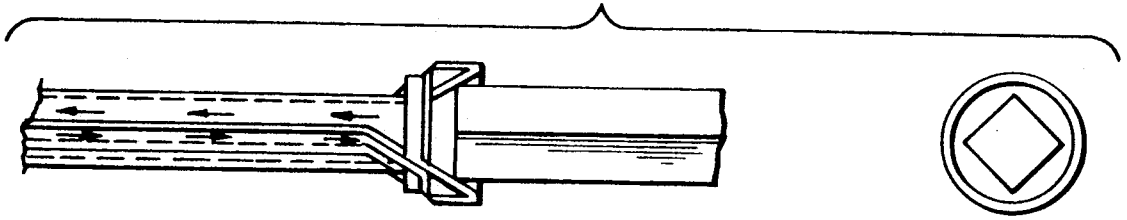

With the above mentioned alternative connections, blanks 1A, 1B, and 1C are shorted-out, via transmission contacts 3 of the set of transmission contacts 3*a*. In this plant the intensity of current may reach up to 40,000 amps, and there is no need of especially advanced contact equipment. Water cooled cups, as shown in FIG. 2*b*, with the edges, or if desired all four corners of the blank are in contact with the contact cups, proved to be sufficient. The edges or, if desired, corners of the blank are the first to be heated and to come to rest at the pressure exterted by cylinders ensuring contact pressure. The edges and, if desired, corners will, thus, get a gradually increasing face of contact with the cups.

The secondary switch, as shown in FIG. 2*a*, comprises two contact members 6′, 6″, which are provided on a control spindle 6‴. At one end of the spindle a pressure cylinder 13 is provided, which acts on spindle 6 and will urge contact members 6′, 6″ towards each other and into contact with current supply members, which extend to transmission contacts 4. Helical springs 14 are inserted between contact members 6′, 6″ and an insulating centering piece 15 between current supply members, causing contact members 6′, 6″ out of contact with current supply members when the secondary switch is disconnected.

A conveyor or manipulator 7, as shown in FIGS. 3, 4, 5*a*, 5*b*, and 6, is provided for insertion, and removal, respectively, of blanks 1 in transmission contacts 3, 4 in chamber 5 through an opening 9, 9*a* in the wall surrounding said chamber. Manipulator 7 comprises gripping members 8 for movement to and from blanks 1, normally on the latter for insertion/removal of the blanks in transmission contacts 3,4 in chamber 5.

Figure 3:
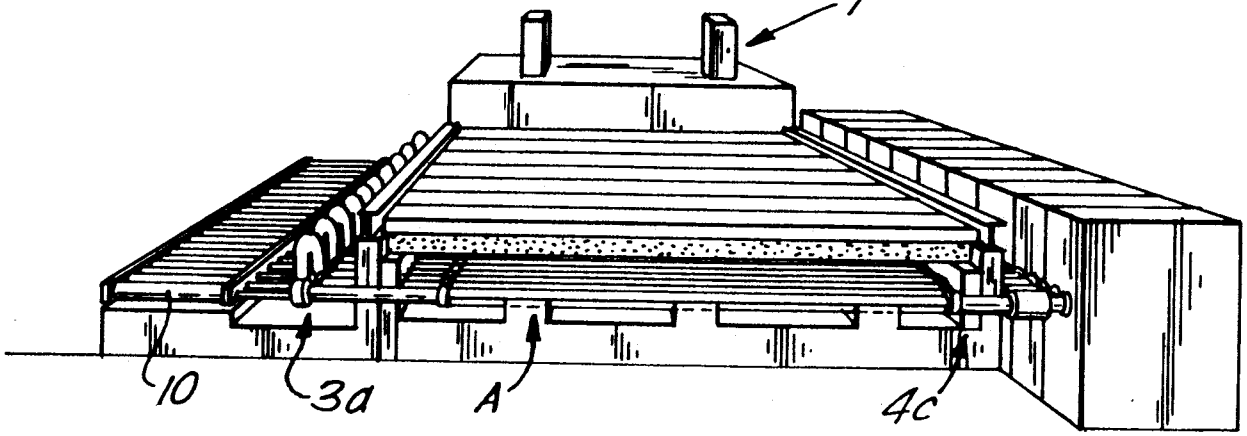
FIG. 3 shows the plant with transmission contacts and blanks placed in one level.
Figure 4:
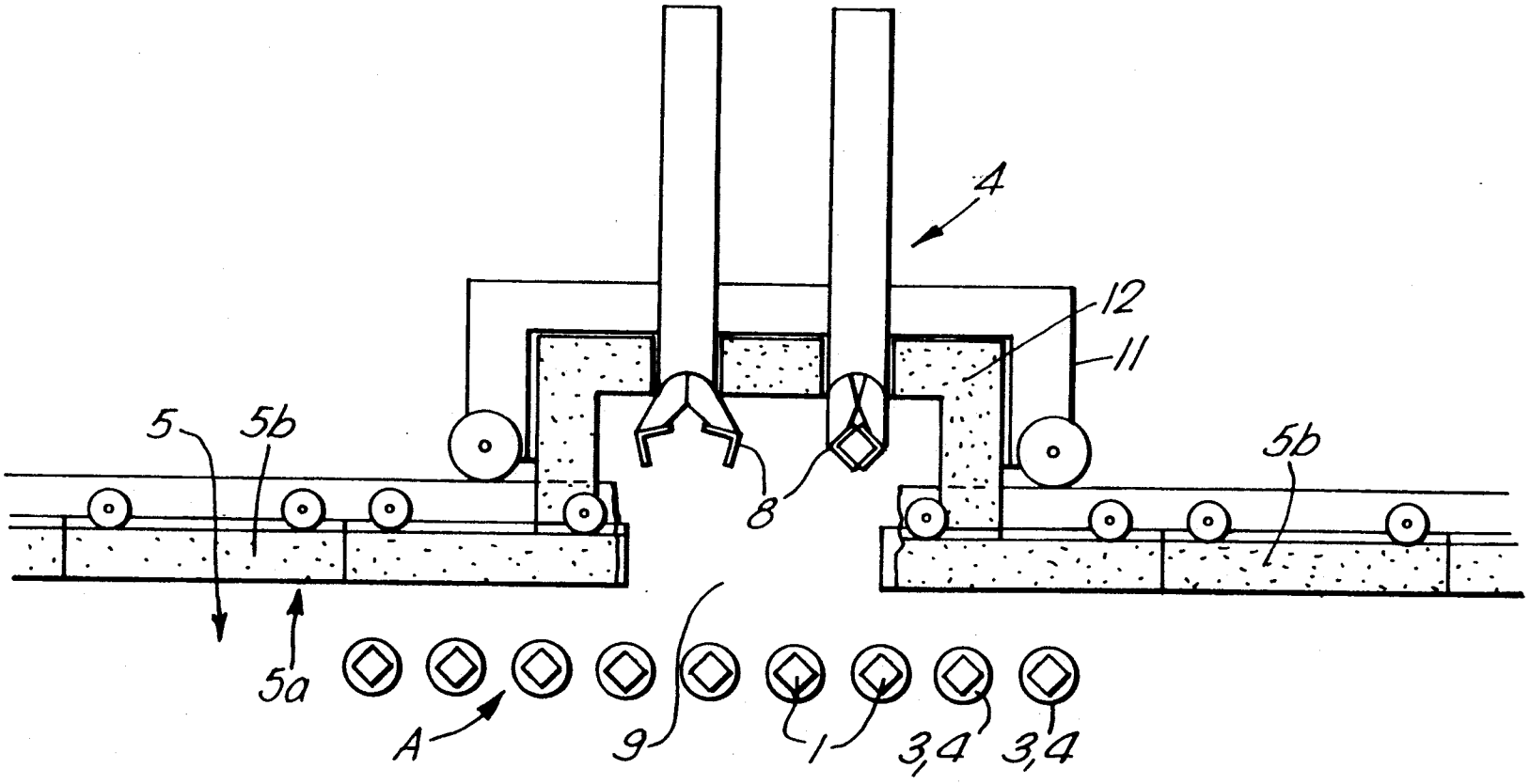
FIG. 4 is a sectional view of a detail of FIG. 3.

In an embodiment shown in FIGS. 3 and 4, manipulator 7 is provided for linear movement to position gripping members 8 for insertion/removal of blanks 1. In a second embodiment, see FIGS. 5*a*, 5*b*, 5*c*, and 6, manipulator 7 is provided for circular movement to position gripping means 8 for insertion/removal of blanks 1.

Transmission contacts 3, 4 of at least one of the sets 3*a*, 4*a*, preferably the first set 3*a*, are axially movable relative to blanks 1 by the aid of preferably hydraulic drive means 10, inter alia as shown in FIGS. 3 and 1. In this case a resilient holding/contact pressure is exerted on the ends of blanks 1.

Chamber 5 with blanks 1 placed in a row A (FIGS. 3 and 4) have an upper wall portion/roof 5*a* with a number of linearly displaceable roof sections 5*b*, which may be displaced apart from each other to form the above mentioned opening 9 in the surrounding chamber wall. A truck 11 is provided to be displaceable across roof 5*a* and is provided with an insulating lock 12 and gripping means 8 for insertion/removal of blanks 1 without loss of heat in chamber 5.

By displacing a roof section 5*b* adjacent to the shown opening 9, a new opening which is displaced relative to the first opening 9, may be achieved, so that gripping means 7 may insert and remove blanks 1 which are placed laterally of the opening shown in FIG. 4.

In order to maintain the temperature of blank 1, and if desired, to set the temperature right during removal and transport, if desired, retaining in lock 12, electric heating elements 1 may be provided in lock 12.

Figure 5A:
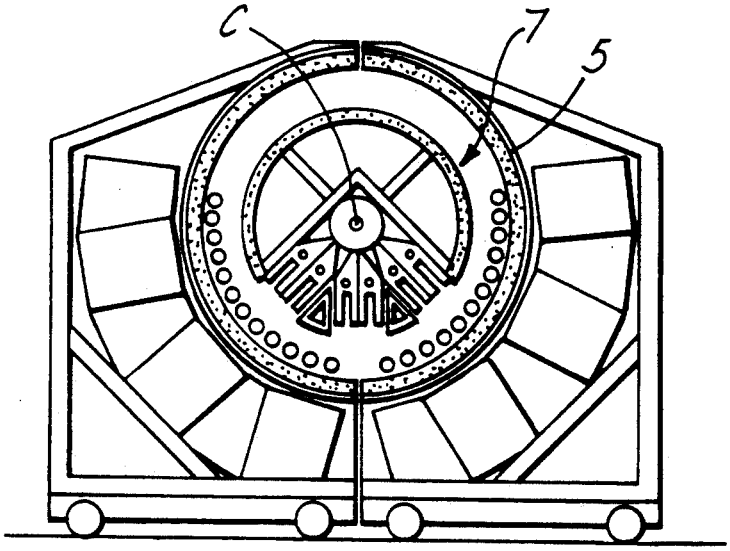
FIG. 5*a* shows a plant with transmission contacts and blanks placed in a circle in a chamber.
Figure 5B:
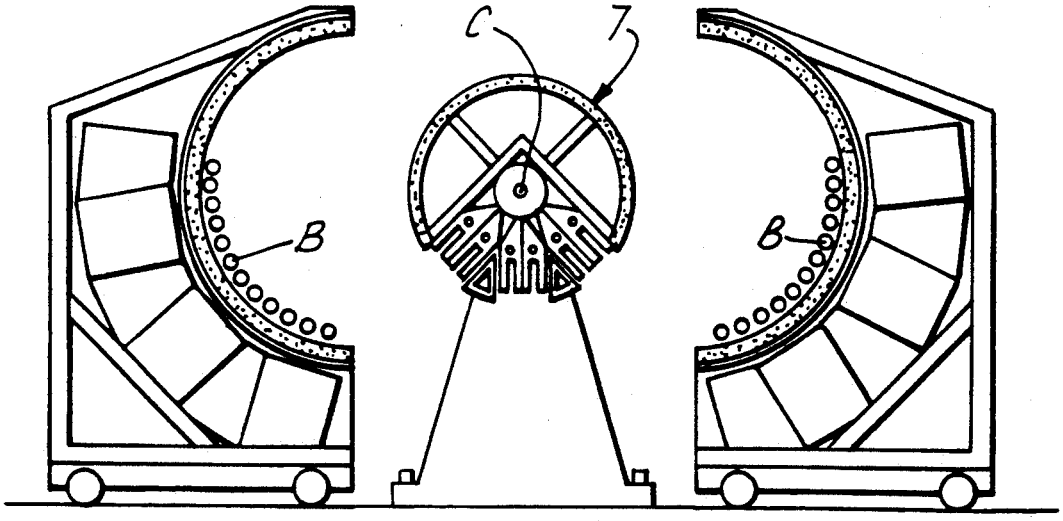
FIG. 5*b* shows the same, with both halves of the chamber separated for maintenance work, etc.
Figure 6:
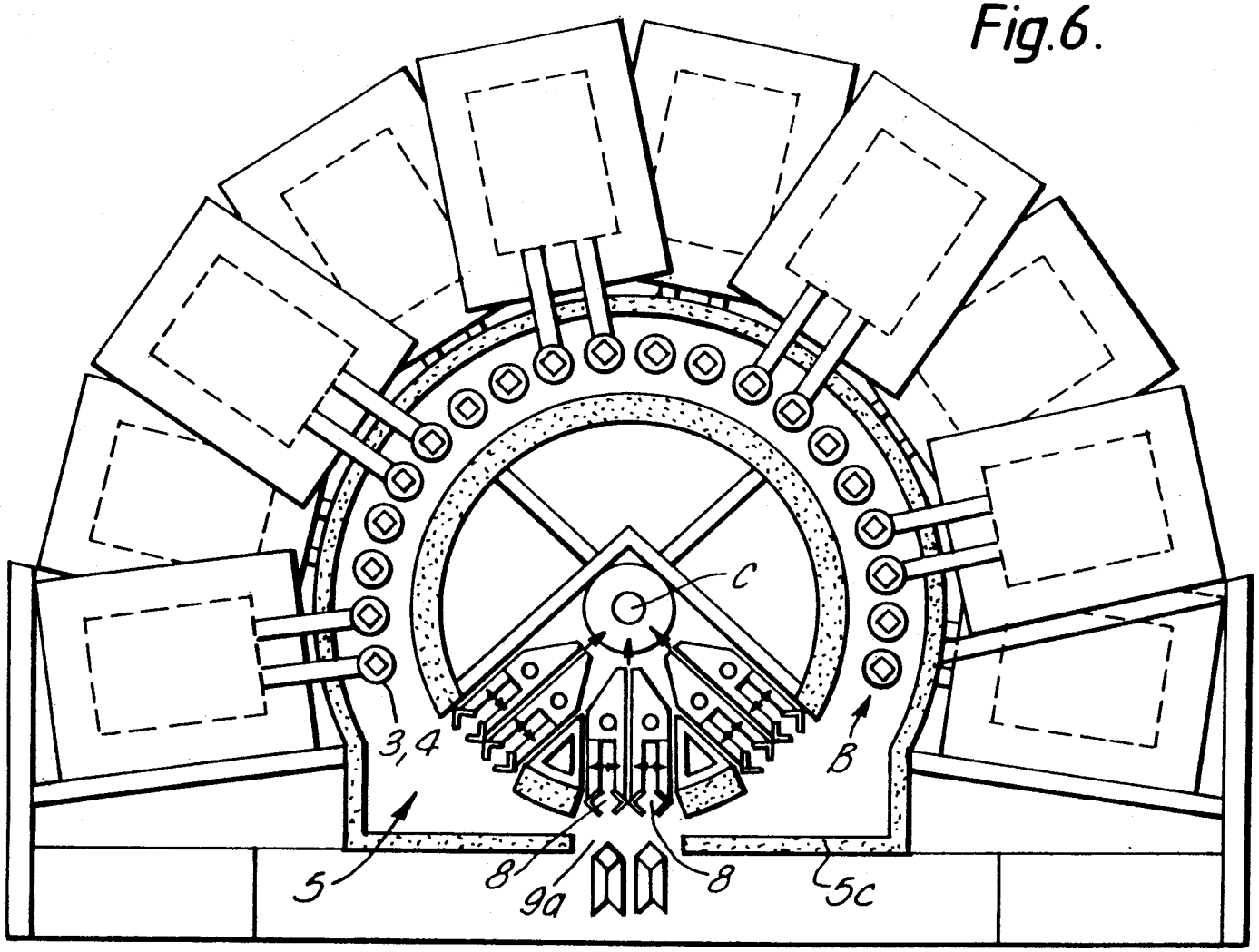
FIG. 6 shows an alternative design of a plant with transmission contacts and blanks placed in an arc of a circle.

In the other embodiment of the plant, as shown in FIGS. 5*a*, 5*b*, and 6, transmission contacts 3, 4 with blanks 1 are placed in a circular arc B. Manipulator 7 with gripping means is placed centrally in said arc. Gripping means 8 are rotatable about a horizontal axis C to be turned in position outside transmission contacts 3, 4, respectively, for insertion/removal of blanks 1 into/-from said contacts. When a blank is removed from a pair of transmission contacts 3, 4, gripping means 8 are turned about axis C towards an opening 9*a* in the bottom of chamber 5, through which blanks 1 may be lowered onto conveyors for transport to the roll mill.

As shown in FIGS. 5*a* and 5*b*, chamber 5 is divided into two members, so that the chamber halves may be displaced laterally and away from manipulator 7, e.g. for maintenance and repair.

As shown, both in FIG. 3 and in FIG. 6, the current supply 2 in the form of transformers with terminals 2*a*, 2*b*, and if desired, 2*c* in case of three-phase transformers, may be provided alternating at one or the other end portion of blanks 1, i.e. at one or the other side of chamber 5, in order to utilize space along the ends of the parallel blanks 1. This is so to permit more width of the transformers than the area occupied by the parallel blanks 1 in the set of blanks, in said Figures two blanks.

I claim:

1. A plant for conductive electrical heating of elongated electrically conductive steel blanks, for further treatment in a mill plant, comprising at least two blanks spaced from each other in a substantially parallel arrangement to each other;

at least one power supply connected to said blanks;

transmission contacts urged toward the ends of said blanks, said transmission contacts connecting said blanks with said power supply;

a heat insulated chamber for constituting an electric furnace with said transmission contacts and said blanks constituting heating elements in said electric furnace;

said heat insulated chamber having an opening in a wall of said chamber;

a manipulating conveying means for insertion and removal of said blanks through said opening in said wall of said chamber;

means to remove blanks in any order from said chamber without stopping the heating process in any other of said heating elements still remaining in said chamber;

said transmission contacts including a first set of transmission contacts which are connected to be shorted, at one end of a set of said blanks, a second set of transmission contacts at an other end of said set of said blanks connected to said power supply, each of said sets of transmission contacts comprising at least three transmission contacts;

terminals of said power supply connecting said second set of transmission contacts to said power supply;

said means to remove blanks in any order including secondary switches connected between said terminals of said power supply and said second set of transmission contacts for connection of alternative circuits through said blanks with at least two of said blanks in a series and one of said blanks in parallel with one of said two aforementioned blanks whereby blanks can be inserted and removed in any order without interfering with heating of other blanks.

2. A plant for conductive electrical heating of elongated electrically conductive steel blanks, for further treatment in a mill plant, comprising at least two blanks spaced from each other in a substantially parallel arrangement to each other;

at least one power supply connected to said blanks;

transmission contacts urged toward the ends of said blanks, said transmission contacts connecting said blanks with said power supply;

a heat insulated chamber for constituting an electric furnace with said transmission contacts and said blanks constituting heating elements is said electric furnace;

said heat insulated chamber having an opening in a wall of said chamber;

a manipulating conveying means for insertion and removal of said blanks through said opening in said wall of said chamber;

means to remove blanks in any order from said chamber without stopping the heating process in any other of said heating elements still remaining in said chamber;

said manipulating conveying means including a gripping means arranged for movement to insert and remove said blanks in said chamber whereby blanks can be inserted and removed in any order without interfering with heating of other blanks.

3. A plant for conductive electrical heating of elongated electrically conductive steel blanks, for further treatment in a mill plant, comprising at least two blanks spaced from each other in a substantially parallel arrangement to each other;

at least one power supply connected to said blanks;

transmission contacts urged toward the ends of said blanks, said transmission contacts connecting said blanks with said power supply;

a heat insulated chamber for constituting an electric furnace with said transmission contacts and said blanks constituting heating elements is said electric furnace;

said heat insulated chamber having an opening in a wall of said chamber;

a manipulating conveying means for insertion and removal of said blanks through said opening in said wall of said chamber;

means to remove blanks in any order from said chamber without stopping the heating process in any other of said heating elements still remaining in said chamber;

pneumatic driving means to move said transmission contacts of at least one of said sets of transmission contacts in an axial direction relative to said blanks forming resilient holding pressure on ends of said blanks whereby blanks can be inserted and removed in any order without interfering with heating of other blanks.

4. A plant for conductive electrical heating of elongated electrically conductive steel blanks, for further treatment in a mill plant, comprising at least two blanks spaced from each other in a substantially parallel arrangement to each other;

at least one power supply connected to said blanks;

transmission contacts urged toward the ends of said blanks, said transmission contacts connecting said blanks with said power supply;

a heat insulated chamber for constituting an electric furnace with said transmission contacts and said blanks constituting heating elements is said electric furnace;

said heat insulated chamber having an opening in a wall of said chamber;

a manipulating conveying means for insertion and removal of said blanks through said opening in said wall of said chamber;

means to remove blanks in any order from said chamber without stopping the heating process in any other of said heating elements still remaining in said chamber;

said chamber having an upper wall portion having a plurality of linearly displaceable roof sections displaceable apart to form an opening in said chamber;

said manipulating conveying means including a conveyor truck displaceable across said upper wall portion including an insulating lock and gripping means for insertion and removal of said blanks without loss of heat from said chamber whereby blanks can be inserted and removed in any order without interfering with heating of other blanks.

5. A plant in accordance with claim 4 wherein heating means are provided in said insulating lock for correcting and maintaining the temperature of said blanks during removal and transport of said blanks.

6. A plant for conductive electrical heating of elongated electrically conductive steel blanks, for further treatment in a mill plant, comprising at least two blanks spaced from each other in a substantially parallel arrangement to each other;

at least one power supply connected to said blanks;

transmission contacts urged toward the ends of said blanks, said transmission contacts connecting said blanks with said power supply;

a heat insulated chamber for constituting an electric furnace with said transmission contacts and said blanks constituting heating elements is said electric furnace;

said heat insulated chamber having an opening in a wall of said chamber;

a manipulating conveying means for insertion and removal of said blanks through said opening in said wall of said chamber;

means to remove blanks in any order from said chamber without stopping the heating process in any other of said heating elements still remaining in said chamber;

said blanks being placed in a circular arc in said chamber;

a hatch in a floor portion of said chamber which may be opened and closed for insertion and removal of said blanks;

a manipulator gripping means rotatable about a horizontal axis for insertion and removal of said blanks whereby blanks can be inserted and removed in any order without interfering with heating of other blanks.

* * * * *